United States Patent [19]

Manten

[11] 4,368,602

[45] Jan. 18, 1983

[54] MOBILE DRILLING RIG HAVING A RETRACTABLE GUIDING MOUNT OR MAST

[76] Inventor: Heinrich Manten, Haselnussweg 3, D-3320 Salzgitter 51, Fed. Rep. of Germany

[21] Appl. No.: 175,199

[22] Filed: Jul. 31, 1980

[30] Foreign Application Priority Data

Aug. 6, 1979 [DE] Fed. Rep. of Germany ..... 2931805

[51] Int. Cl.[3] ..... E21C 11/02

[52] U.S. Cl. ..... 52/115; 52/116; 173/28

[58] Field of Search ..... 52/115, 116; 173/28, 173/43, 42; 182/63, 65

[56] References Cited

U.S. PATENT DOCUMENTS

| | | | |
|---|---|---|---|
| 1,531,982 | 3/1925 | Sago | 182/63 |
| 2,903,949 | 9/1959 | Simmonds | 173/28 |
| 3,205,627 | 9/1965 | Gyongyosi | 52/116 |
| 3,550,693 | 12/1970 | Bermingham | 173/43 |
| 3,919,816 | 11/1975 | Ranft | 173/43 |
| 4,088,289 | 5/1978 | Wood | 52/116 |
| 4,102,094 | 7/1978 | MacKinnon | 52/116 |

FOREIGN PATENT DOCUMENTS 1101692 1/1968 United Kingdom .

*Primary Examiner*—Reinaldo P. Machado
*Attorney, Agent, or Firm*—Michael J. Striker

[57] ABSTRACT

The mobile drilling machine includes a full track or wheeled undercarriage, a drilling mast provided with first guiding tracks extending in the longitudinal direction of the mast for guiding a rotary turntable for drilling pipes and with second guiding tracks, a slider movable on the second guiding tracks, a short supporting arm hinged between the undercarriage and a lower part of the mast, a longer supporting arm hinged at a different point on the undercarriage and connected by a universal joint to the slider and a self-locking driving mechanism provided on the slider to engage a tooth rack or chain mounted on the slider to adjust the inclination of the mast when actuated.

7 Claims, 6 Drawing Figures

11
C
10'
10
8
B
12'
7
6
A
15'
13
12'
3
5
14'
15
4
2'
8
12
2
1
14

11
C
V
V
B
12'
A
13
5
5
12
16
5'
15
5'
15
2
1

C
B
6
15'
3
A
5
17
18
14'
19
8
4

10
10'
7
5
13
8
12'
10
6
10'
5
15'

3
M
C
B
6
A
5
8
4
1

M
8
A
B
C
3
4
5
6

MOBILE DRILLING RIG HAVING A RETRACTABLE GUIDING MOUNT OR MAST

BACKGROUND OF THE INVENTION

The invention relates generally to self-propelled earth or rock drilling machines having a retractable mount for the power driven turntable or rotary drive for the drill pipes which is applicable for drilling anchoring bore holes on construction sites or for drilling blast holes in quarries.

From prior art drilling machines of this kind are known which are equipped either with a relatively short mount for the turntable which may be provided with a storage compartment for drill pipes and is movably supported on a cantilever beam whereby upon drilling a bore hole about the length of one drill pipe an extension drill pipe has to be added; in a modification, a drilling mast is pivotably supported on a platform of a self-propelled undercarriage and can be erected or retracted by means of a supporting cylinder. The above-described known drilling machines are described for example in the brochures WO26.779.1500 P, W275.679.500 A and W386.678.1000 G of the German firm Salzgitter Maschinen und Anlagen AG.

In the latter embodiment of the known drilling machine, it is possible to drill a hole over the entire length of the mast without the necessity of extending the drill pipes. The permissible length of the mast depends on the total weight of the machine inasmuch as during the movement from one drilling site to another one with erected mast, it is necessary to ensure that the mobile machine does not overturn even if moved on a rough surface. The retraction of the mast before the transport, however, has the disadvantage that a considerable part of the mast overhangs the undercarriage. Moreover, the structure of the mast must be very stable because in the horizontal or in an inclined position the mast is subject to a large bending moment in the range of the supporting points because of the increased cantilever load.

The disadvantage of the first mentioned embodiment of the known drilling machines is to be seen in the fact that due to the necessity to extend the drill string considerable wasted time results and furthermore the provision of a storage compartment for the drill pipes makes the machine more expensive and susceptible to failures. In the second embodiment of the known machines, the total weight of the rig is very high and this in turn leads to higher costs. In addition, the maximum length of the drilling mast is limited presently to about 10 to 15 meters which length is unfavorably small.

SUMMARY OF THE INVENTION

A general object of this invention is to overcome the aforementioned disadvantages.

More specifically, an object of this invention is to provide an improved mobile drilling machine of the abovedescribed type which at a reduced total weight enables the drilling of deeper bore holes without the necessity of extending the drill pipes during the drilling operation.

An additional object of the invention is to provide such an improved drilling machine which improves the transportation conditions.

A further object of the invention is to provide such an improved drilling machine which, due to its lower weight requires less energy for transportation and is also less expensive to manufacture.

In keeping with these objects, and others which will become apparent hereafter, one feature of the invention resides, in a mobile drilling machine having an elongated mast or mount with first guiding means for the rotary drive for the drill pipes and a self-propelled undercarriage, in the provision of two supporting arms of different lengths which are pivotably attached at different points on the undercarriage, second guiding means formed on the mast, a slider movable on the second guiding means, the free end of one arm being hinged to the mast and the free end of the other arm being hinged to the slider and a power drive between the mast and the slider to displace the same along the second guiding means.

By virtue of the resulting four bar linkage constituted by the undercarriage, the two hinged arms and an adjustable length of the mast, it is possible to retract the elongated mount or the mast in such a manner that its point of gravity M both in the erected vertical position and in the retracted horizontal position remains always within the limits of the tilting edges of the undercarriage. As a consequence, the drilling machine of this invention is ready for the drilling operation in any angular position of its guiding mount or mast. Furthermore, due to the fact that the mast is supported on two pivot axes, the load of the mast is equal to that of a beam on two supports and consequently the mast of a reduced weight can be employed. In moving from one drilling point to another one the mast can be retracted within one minute so that the whole machine could move even on a rough terrain without the danger of turning over. The total weight of the machine can be reduced with respect to prior art machines designed for drilling the bore holes of the same depth by about one-third. Inasmuch as it is possible to design the mast of an increased length, it is possible to drill deeper bore holes without the necessity of extending the drill string; nonetheless, if desired, it is possible to apply extension pipes while maintaining all aforementioned advantages. In one embodiment of this invention, the power drive means for the slider on the mast is a self-locking power drive which cooperates with a tooth rack or a chain arranged on the mount or the mast. This solution has the advantage that due to the positive connection established by the chain and chain wheel or a tooth rack and a driving pinion, it is ensured that even at an inclined position of the mast no sliding effects take place. In addition, this arrangement is relatively low in weight inasmuch as only one chain is necessary. The displacement of the slider by means of a circulating chain with corresponding driving motor and transmission gears is also possible but this arrangement is considerably heavier and more costly.

According to another embodiment of this invention the power drive for the slider is a cylinder and piston unit hinged between the slider and the mast. It is true that this construction is a little heavier, but it has the advantage in the simplicity of the design and the control is very sensitive and accurate. Moreover, the operational safety of the cylinder and piston unit is very favorable and is almost maintenance-free and corrosion-resistant.

In a further embodiment of this invention the arms are linked to the slider and to the supporting undercarriage by means of universal joints whereby the long arm is constituted by a pair of braces at least one of which is adjustable in length. Due to the application of universal joints and due to the longitudinal adjustability of lateral braces the mount or the mast can be angularly adjusted in transverse direction relative to the undercarriage. Accordingly, when the ground is uneven, the transverse inclination of the mast made by shortening or extending the adjustable braces enables the setting of a perpendicular position of the mast relative to the ground.

In still another embodiment of this invention, one of the hinged arms is controlled by another cylinder and piston unit which is hinged between the carriage and the one arm to control the angular position of the one arm independently from the power drive on the slider. By tilting the one arm by means of the unit the mount or the mast can be adjusted in a horizontal position which is in close proximity to the upper surface of the undercarriage. In this manner, the point of gravity M of the mast is placed at its lowermost point and the transportation capability of the mobile rig is greatly increased.

In still another embodiment of this invention the undercarriage is provided on its top with a rotatable platform driven for example by means of a gear ring about a central pivot so that the mount or the mast can be rotated about at least 90° with respect to the longitudinal axis of the undercarriage. By this measure the mount or the mast together with the rod driving unit and the feeding mechanism can be angularly adjusted transversely to the direction of movement of the undercarriage and consequently it is possible to drill also at the longitudinal track sides of the undercarriage.

In another modification, both arms are mounted on a slider whereby the slider of the shorter arm is controlled by another cylinder and piston unit hinged to the mast. This arrangement enables that the mast can be lowered in its erected position to abut with its lower end against the ground when it is desired for a better stability during the drilling operation. In this manner particularly in an uneven terrain a three-point support is attained, namely between the foot of the mount or of the mast and the two full tracks of the undercarriage.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

DESCRIPTION OF THE PREFERRED EMBODIMENTS

Figure 1:
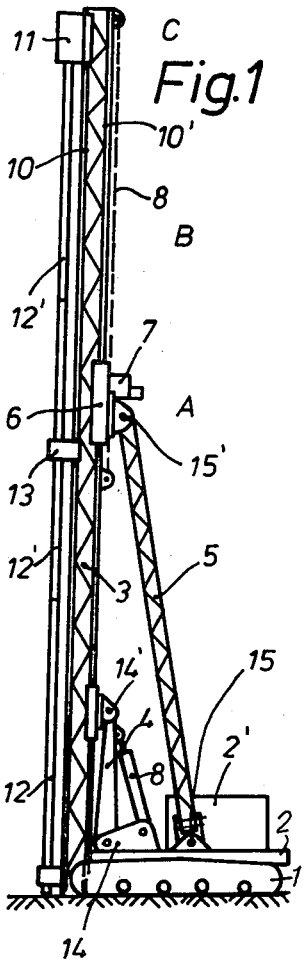
FIG. 1 is a side view of the rig of this invention shown in its operative drilling position with an erected mast.
Figure 5:
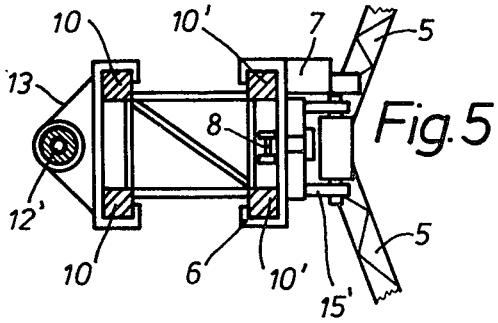
FIG. 5 is a sectional top view of the mast taken along the line V—V of FIG. 2.

FIG. 1 shows a mobile full track undercarriage 1 provided on its top with a platform 2 which on its front part is formed with a hinge 14 for a supporting arm 4. The upper end of the arm 4 is linked to a universal joint 14' attached to a lower portion of mast 3. Instead of the full track undercarriage 1 it is also possible to use a mass produced undercarriage of a stripping shovel or of a crane or the like supporting carriage. The drilling mount or mast has a grid structure whereby the longitudinal carrier beams 10' serve as guiding tracks for supporting sliders as it will be explained below with reference to FIG. 5. The front beams 10 of the mast are utilized as guiding tracks for a turntable or a rotary drive 11 for drilling pipes 12 and 12' and also support a drill pipe centralizer 13. Instead of rotary drilling units it is also possible to mount on the mast 3 a cable or percussion drilling system. The feeding and reverse movement of the drill pipes is effected by a non-illustrated feeding chain driven by a separate driving motor or via cables or motor driven winch. The hinged supporting arm 4 is linked to a cylinder and piston unit 8 which is also pivotably mounted in the hinge 14 to tilt the arm 4 forwardly by about 90°. In the rest position, the arm 4 and the associated cylinder and piston unit 8 form together a stable support for the mount or mast 3 at the lower hinge point 14'. A pair of supporting arms 5 which exceed in length the supporting arm 4 are connected to supporting legs 5' which in turn are linked by universal joints 15 to a central part of the platform 2. The free ends of the long arms 5 are hinged to a slider 6 which is movable on the rear guiding tracks 10' on the mast 3. As illustrated in FIG. 5, the slider 6 embraces the edges of rectangular guiding beams 10' and supports also self-locking driving gears driven by a motor 7. A chain or tooth rack 8 is mounted on the rear side of the mast 3 between the guiding tracks 10' to engage a driving pinion of the self-locking gears. In the erected position of the mast the slider 6 is in position A approximately at the center of the mast 3. By energizing the motor 7, the self-locking gears rotate the driving pinion which engages the chain or the tooth rack 8 on the mast 3 and consequently the slider 6 is displaced from the position A towards its uppermost position C. In each intermediate position when the driving motor 7 is deenergized the driving gears due to their self-locking action ensure that the slider is firmly locked in any position and consequently the mast can be inclined and firmly held in any angular position. In this manner, all forces acting in the longitudinal or transverse direction on the mast 3 as well as the rotary moments during the drilling operation are intercepted by the slider 6, universal joints 15', the pair of supporting long arms 5 and by the support made by the short arm 4 and the cylinder and piston unit 8. The mast, the supporting arms and the platform or the undercarriage thus form an adjustable four bar linkage. A power supply aggregate 2' is also mounted on the platform 2 and includes a main driving motor, pumps or compressors for a hydraulic circuit controlling the cylinder and piston units and electrical control circuits for the motor 7 and for the driving motor in the drive unit 11.

Figure 2:
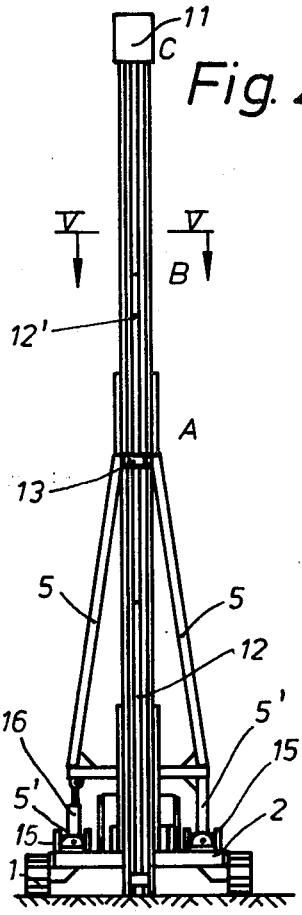
FIG. 2 is a front view of the rig of FIG. 1.

As seen from FIG. 2, at least one of the supporting legs 5' is equipped with a vertically adjustable cylinder and piston unit 16 to adjust the lateral angular position of the mast 3. By changing the stroke of the cylinder and piston unit 16 the supporting leg 5 is swung about its universal joint 15 and the mast is tilted at the point A both in the universal joint 15' and in the universal joint 14'. The lateral angular adjustment of the mast is employed in the case when the undercarriage 1 is standing on an uneven ground and the mast is to be adjusted into an exactly perpendicular position.

Figure 3:
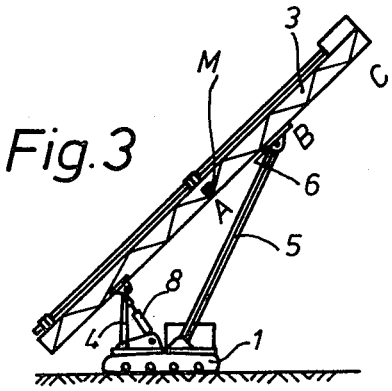
FIG. 3 is a side view of the self-propelled rig of this invention in a drilling position with inclined mast.

FIG. 3 illustrates an inclined position of the mast 3 in which the slider is displaced from its position A into its position B whereby the position of the shorter supporting arm 4 remains unchanged. In this manner, the mast 3 is inclined about 45° and its center point of gravity M is located slightly behind the center of the undercarriage 1.

Figure 4:
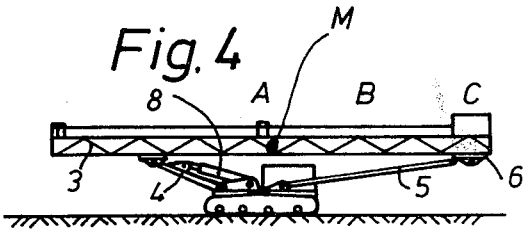
FIG. 4 is a side view of the mobile drilling rig with retracted mast held in a horizontal position for transportation.

A retracted position of the mast 3 is shown in FIG. 4. In this position, the slider 6 is displaced into its uppermost position C and the short arm 4 is tilted forwardly by about 30° with respect to a horizontal line. As a consequence, the mount or mast 3 assumes a horizontal position. By tilting the short arm 4 forwardly the mast 3 is shifted slightly to the left and as a result the point of gravity M is now located above the center point of the undercarriage 1. For this reason, it is ensured that the mobile drilling apparatus has a maximum safety against tilting even during its movement on a very rough terrain. The length of the short arm 4 depends on the overall length of the mount or of the mast and preferably it amounts to about one-sixth or one-fifth of this total length.

FIG. 5 shows in more detail the arrangement of the universal joint 15', of the slider 6 which embraces the guiding beams 10' of the mast and supports the driving unit 7 with self-locking transmission gears including a driving pinion which engages the tooth rack 8 attached to the mast.

Figure 6:
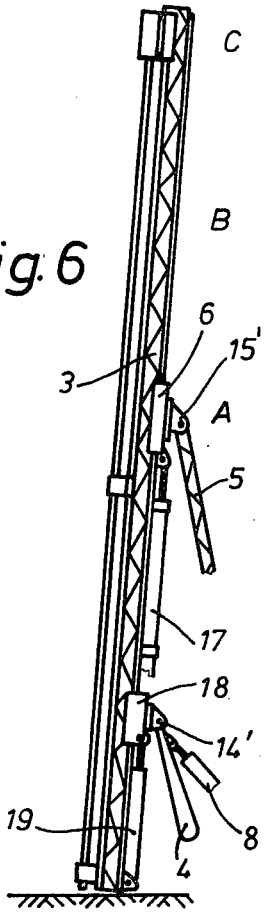
FIG. 6 is a side view of a cut-away part of the rig of FIG. 1 shown with a modified version of the mast support.

FIG. 6 shows a modification in which the short arm 4 is linked to another slider 18 movable along the guiding beams 10'. Both sliders 6 and 18 are displaced by hydraulically controlled cylinder and piston units 17 and 19 pivotably mounted on the mast 3. The lower cylinder and piston unit 19 which is hinged to the foot of the mast is designed such as to withstand and move not only the weight of the mast 3, but also to be capable of lifting the undercarriage 1 when the mast 3 rests on the ground. In addition, by means of this arrangement it is possible to adjust the overlap of the mast in its horizontal position inasmuch as the displacement of the tiltable short arm 4 is added to the stroke of the cylinder and piston unit 19.

It will be understood that each of the elements described above, or two or more together, may also find a useful application in other types of constructions differing from the types described above.

While the invention has been illustrated and described as embodied in a mobile drilling rig for use with rotary drill pipes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A mobile drilling machine comprising a mobile undercarriage; a mast for supporting and guiding a drive unit for drilling tools; a slider arranged for movement in the longitudinal direction on said mast; at least one first arm of a constant length hinged at fixed points relative to said mast and said under carriage; at least one single second arm of a constant length hinged at fixed points relative to said slider and said undercarriage; the hinge points of said first and second arms on said undercarriage being spaced apart from each other about a constant distance; a self-locking power drive arranged between said mast and said slider to displace the same to a desired position on said mast; and a hydraulically driven cylinder-and-piston unit hinged at fixed points relative to said first arm and said undercarriage to tilt said mast in cooperation with said self-locking power drive about the corresponding hinge points of said first and second arms.

2. A drilling machine as defined in claim 1, wherein said power drive includes self-locking transmission gears coupled to a driving pinion and a tooth rack or chain secured to said elongated member and being in mesh with said pinion.

3. A drilling machine as defined in claim 1, wherein said power drive is a hydraulic cylinder and piston unit hinged at one end to said elongated member and at the other end to said slider.

4. A drilling machine as defined in claim 1, wherein said first and second supporting arms are hinged between said elongated member, said slider and said undercarriage by universal joints.

5. A drilling machine as defined in claim 4, including two second supporting arms hinged to a common point on said slider at least one of said second arms being provided with a vertically adjustable leg hinged to said undercarriage to adjust lateral inclination of said elongated member, and the length of said second arms being larger than that of said first arm.

6. A drilling machine as defined in claim 1, further including a platform mounted on said carriage and supporting said two arms and said elongated member, and means for rotating said platform about a central pivot point.

7. A drilling machine as defined in claim 1, further including an additional slider arranged for movement on said elongated member and being hinged to the free end of said first arm and further including an additional hydraulic cylinder and piston unit hinged between said additional slider and said elongated member.

* * * * *